US010682866B2

(12) United States Patent
Irie

(10) Patent No.: US 10,682,866 B2
(45) Date of Patent: Jun. 16, 2020

(54) PRINTING SYSTEM, PRINTING APPARATUS, DEVICE AND RECORDING MEDIUM

(71) Applicant: CASIO COMPUTER CO., LTD., Shibuya-ku, Tokyo (JP)

(72) Inventor: Tamotsu Irie, Higashiyamato (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/004,015

(22) Filed: Jun. 8, 2018

(65) Prior Publication Data

US 2018/0361736 A1 Dec. 20, 2018

(30) Foreign Application Priority Data

Jun. 16, 2017 (JP) ..... 2017-118646

(51) Int. Cl.

| | |
|---|---|
| ***B41J 3/407*** | (2006.01) |
| ***A45D 29/22*** | (2006.01) |
| ***B41J 2/045*** | (2006.01) |
| ***B41M 5/00*** | (2006.01) |
| ***A45D 29/00*** | (2006.01) |

(52) U.S. Cl.

CPC ..... *B41J 3/4073* (2013.01); *A45D 29/00* (2013.01); *A45D 29/22* (2013.01); *B41J 2/04505* (2013.01); *B41J 2/04586* (2013.01); *B41M 5/0047* (2013.01); *A45D 2029/005* (2013.01)

(58) Field of Classification Search

CPC ..... A45D 29/22; A45D 2029/005

See application file for complete search history.

(56) References Cited

U.S. PATENT DOCUMENTS

| | | | | |
|---|---|---|---|---|
| 5,931,166 | A | 8/1999 | Weber et al. | |
| 6,067,996 | A | 5/2000 | Weber et al. | |
| 6,286,517 | B1 | 9/2001 | Weber et al. | |
| 2009/0153604 | A1* | 6/2009 | Chen | B41J 3/28 347/9 |
| 2012/0113171 | A1* | 5/2012 | Murata | B41J 3/407 347/2 |
| 2016/0345708 | A1* | 12/2016 | Walia | A45D 29/22 |
| 2017/0008277 | A1* | 1/2017 | Matsuda | B41J 2/04536 |
| 2017/0008305 | A1* | 1/2017 | Kobayashi | B41J 3/4073 |
| 2018/0263356 | A1* | 9/2018 | Cao | H04N 1/3872 |

FOREIGN PATENT DOCUMENTS

| | | | |
|---|---|---|---|
| JP | 2003534083 | A | 11/2003 |

* cited by examiner

*Primary Examiner* — Shelby L Fidler

(74) *Attorney, Agent, or Firm* — Holtz, Holtz, & Volek PC

(57) ABSTRACT

A printing system includes a printing apparatus and a device. The printing apparatus includes a printing head, a fixture jig and a fixture platform. The printing head prints a design on a nail of a finger or toe. The fixture jig is detachable from the printing apparatus, includes a reference mark, and fixes the finger or toe. In the fixture platform, the fixture jig is set such that the reference mark and the nail of the finger or toe is in an X-Y plane. The device includes a communicator, an imaging unit and a processor. The communicator communicates with the printing apparatus. The imaging unit images the fixture jig with the finger or toe fixed thereon to obtain an image of the reference mark and the nail.

7 Claims, 6 Drawing Sheets

PRINTING SYSTEM, PRINTING APPARATUS, DEVICE AND RECORDING MEDIUM

CROSS REFERENCE TO RELATED APPLICATION

This application is based upon and claims the benefit of priority under 35 USC 119 of Japanese Patent Application No. 2017-118646 filed on Jun. 16, 2017, the entire disclosure of which, including the description, claims, drawings and abstract, is incorporated herein by reference in its entirety.

BACKGROUND OF THE INVENTION

1. Field of the Invention

The present invention relates to a printing system, a printing apparatus, a device and a recording medium.

2. Description of Related Art

Printing apparatuses that print a nail design on a nail or a nail chip have been known in the art.

Such apparatuses require accurately detecting the area of a nail on which an image is to be printed (hereinafter referred to as a "nail area") in order to specify a printing position and a printing area.

With regard to detecting a nail area, printing apparatuses have been proposed which are equipped with a camera for taking a nail image and which extracts a nail area from the nail image taken with the camera by image processing (e.g. JP 2003-534083A).

By taking an image of a finger with a nail and extracting a nail area from the image, it is possible to accurately specify a printing area and to generate printing data based on the printing area.

However, provision of a camera to a printing apparatus results in a reasonable increase of the apparatus cost, the complex wiring in the apparatus and the like.

The present invention is advantageous in providing a printing system, a printing apparatus, a device and a recording medium that enable accurately printing a design on a nail with a simple and inexpensive configuration.

SUMMARY OF THE INVENTION

To achieve at least one of the abovementioned objects, according to an aspect of the present invention, a printing system includes:

a printing apparatus; and a device, wherein the printing apparatus includes:

a printing head which prints a design on a nail of a print finger or toe;

a fixture jig which is detachable from the printing apparatus, which includes a reference mark and which fixes the print finger or toe; and a fixture platform in which the fixture jig is set such that the reference mark and the nail of the print finger or toe is in an X-Y plane, wherein the device includes:

a communicator which communicates with the printing apparatus;

an imaging unit which images the fixture jig with the print finger or toe fixed thereon to obtain an image of the reference mark and the nail; and a processor, and wherein the processor (i) detects a position of the reference mark and an area of the nail from the image obtained by the imaging unit and (ii) sets a printing area of the printing head based on a detection result by the processor and generates printing data.

According to another aspect of the present invention, a printing apparatus includes:

a printing head which prints a design on a nail of a print finger or toe;

a fixture jig which is detachable from the printing apparatus, which includes a reference mark and which fixes the print finger or toe;

a fixture platform in which the fixture jig is set such that the reference mark and the nail are in an X-Y plane;

a communicator which communicates with a device for generating printing data; and a processor, wherein the processor (i) detects a position of the reference mark and an area of the nail from an image of the reference mark and the nail, the image being obtained by imaging the fixture jig with the print finger or toe fixed thereon at a location outside the printing apparatus, and (ii) the processor sets a printing area of the printing head based on a detection result.

According to another aspect of the present invention, a device includes:

a communicator that communicates with a printing apparatus which includes: a printing head which prints a design on a nail of a print finger or toe; a fixture jig which is detachable from the printing apparatus, which includes a reference mark and which fixes the print finger or toe; and a fixture platform in which the fixture jig is set such that the reference mark and the nail are in an X-Y plane;

an imaging unit; and a processor, wherein the processor (i) obtains an image of the reference mark and the nail by controlling the imaging unit to image the fixture jig with the print finger or toe fixed thereon at a location outside the printing apparatus, (iii) detects a position of the reference mark and an area of the nail from the obtained image, (iii) sets a printing area of the printing head based on a detection result of the area of the nail and generates printing data, and (iv) sends the printing data to the printing apparatus by controlling the communicator.

According to another aspect of the present invention, a recording medium stores a program which is readable by a computer of a printing apparatus which includes: a printing head which prints an image on a nail of a print finger or toe; a fixture jig which is detachable from the printing apparatus, which comprises a reference mark and which fixes the print finger or toe; a fixture platform in which the fixture jig is set such that the reference mark and the nail are in an X-Y plane; and a communicator which communicates with a device for generating printing data, the program making the computer perform the following processing of:

detecting a position of the reference mark and an area of the nail from an image of the reference mark and the nail, the image being obtained by imaging the fixture jig with the print finger or toe fixed thereon at a location outside the apparatus; and setting a printing area of the printing head based on a detection result.

According to another aspect of the present invention, a recording medium stores a program which is readable by a computer of a device which includes: a communicator which communicates with a printing apparatus; and an imaging unit, wherein the printing apparatus includes: a printing head which prints a design on a nail of a print finger or toe; a fixture jig which is detachable from the printing apparatus, which comprises a reference mark and which fixes the print finger or toe; and a fixture platform in which the fixture jig is set such that the reference mark and the nail are in an X-Y plane, the program making the computer perform the following processing of:

obtaining an image of the reference mark and the nail by controlling the imaging unit to image the fixture jig with the print finger or toe fixed thereon at a location outside the apparatus;

detecting a position of the reference mark and an area of the nail from the obtained image;

setting a printing area of the printing head based on a detection result of the area of the nail and generating printing data; and sending the printing data to the printing apparatus by controlling the communicator.

BRIEF DESCRIPTION OF THE PRINTINGS

The advantages and features provided by one or more embodiments of the invention will become more fully understood from the detailed description given hereinbelow and the appended printings which are given by way of illustration only, and thus are not intended as a definition of the limits of the present invention, and wherein.

DETAILED DESCRIPTION OF THE PREFERRED EMBODIMENT

Hereinafter, a printing system, a printing apparatus and a device according to an embodiment of the present invention will be described referring to FIG. 1 to FIG. 7.

While the following embodiment is characterized by a variety of limitations that are technically preferred for carrying out the present invention, it is not intended to limit the scope of the present invention by the following embodiment and illustrated examples.

Further, the following embodiment is an example in which the printing apparatus is constituted by a nail printer that prints an image on a finger nail as a printing object. However, the printing objects of the printing apparatus of the present invention are not limited to finger nails but may include toe nails, nail chips and the like.

Overall Configuration of Printing System

Figure 1:
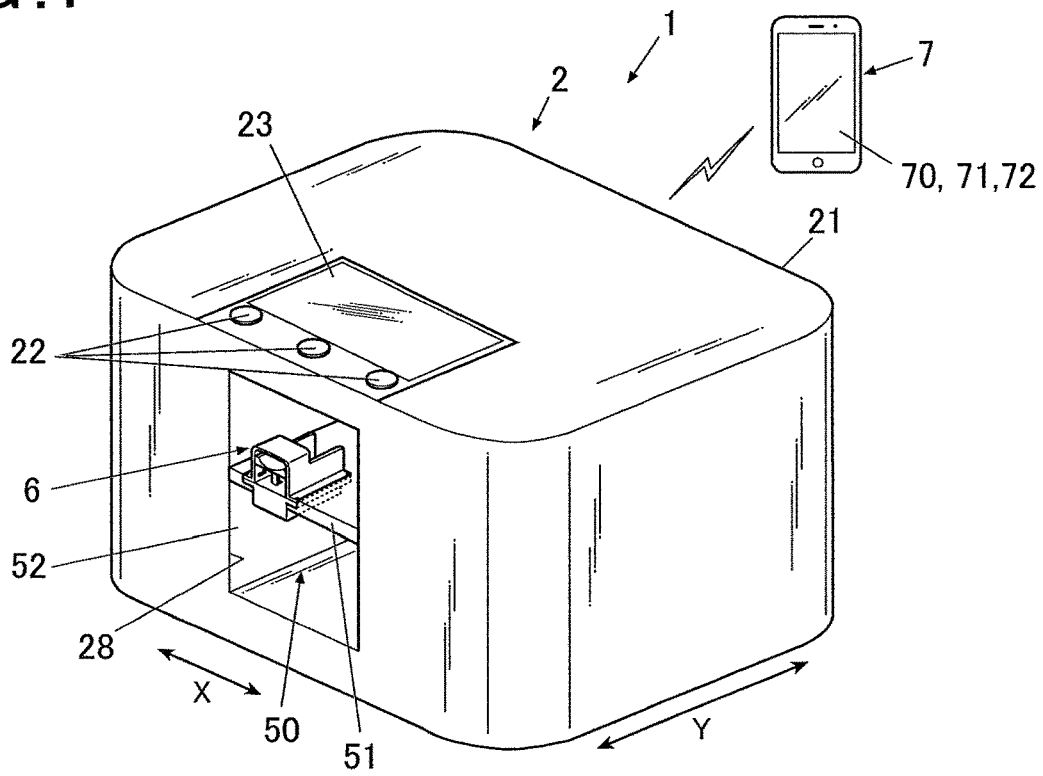
FIG. 1 is a perspective view of the overall configuration of a printing system according to an embodiment.

FIG. 1 is the schematic overall configuration of the printing system according to the embodiment.

As illustrated in FIG. 1, the printing system 1 of the embodiment includes a nail printer 2 as a printing apparatus and a device 7 that can communicate with the nail printer 2.

While the device 7 is depicted as a smartphone in FIG. 1, the device 7 is not limited to smartphones. For example, the device 7 may be constituted by a tablet personal computer (hereinafter referred to as a PC), a notebook PC, a desktop PC or the like. A wide variety of apparatuses that can communicate with the nail printer 2 and that has a camera function may be used as the device 7. For example, the device 7 may also be constituted by a digital camera having a wireless communication function.

The communication between the nail printer 2 and the device 7 may be made through a network such as the Internet or based on a wireless communication according to a near field wireless communication standard such as BLUETOOTH (registered trademark) or Wi-Fi. When the communication is made through a network, any type of network may be used for the communication.

The communication between the nail printer 2 and the device 7 is not limited to wireless communication, but they may be configured to be able to send and receive various data therebetween with wired connection.

In the following, the nail printer 2 and the device of the printing system 1 according to the embodiment will be described in detail.

Configuration of Nail Printer

As illustrated in FIG. 1, the nail printer 2 as the printing apparatus of the embodiment includes a case 21 that is formed in an approximately box shape.

On a top face (top panel) of the case 21, an operation interface 22 is disposed.

The operation interface 22 is an input section for a variety of user inputs.

For example, the operation interface 22 includes operation buttons for a variety of inputs such as a power switch button for turning on the nail printer 2, a stop switch button for stopping an operation and a printing start button for starting printing.

At the top face (top panel) of the case 21, a display 23 is also disposed.

For example, the display 23 is constituted by a liquid crystal display (LCD), an organic electroluminescence display, a flat display of another type, or the like.

In the embodiment, for example, a variety of instructions, messages and the like are suitably displayed on the display 23.

A touch panel for a variety of inputs may be integrated on the surface of the display 23. In this case, the touch panel serves as the operation interface 22.

At a front side (front side in FIG. 1) of the case 21, a finger insertion opening 28 is formed as an opening in which a finger is inserted when the nail printer 2 prints a design.

The nail printer 2 of the embodiment is configured such that a fixture jig 6 (described later) is inserted in or taken out through the finger insertion opening 28 with a print finger U1 and the nail T thereof fixed on the fixture jig 6. Accordingly, the finger insertion opening 28 is formed in such a size that does not interfere with the fixture jig 6 as well as the print finger U1 and the nail T fixed thereto when they are inserted in or taken out of the printer.

As used herein, the print finger U1 refers to a finger that has the nail T as a printing object of the printer 40.

Figure 2:
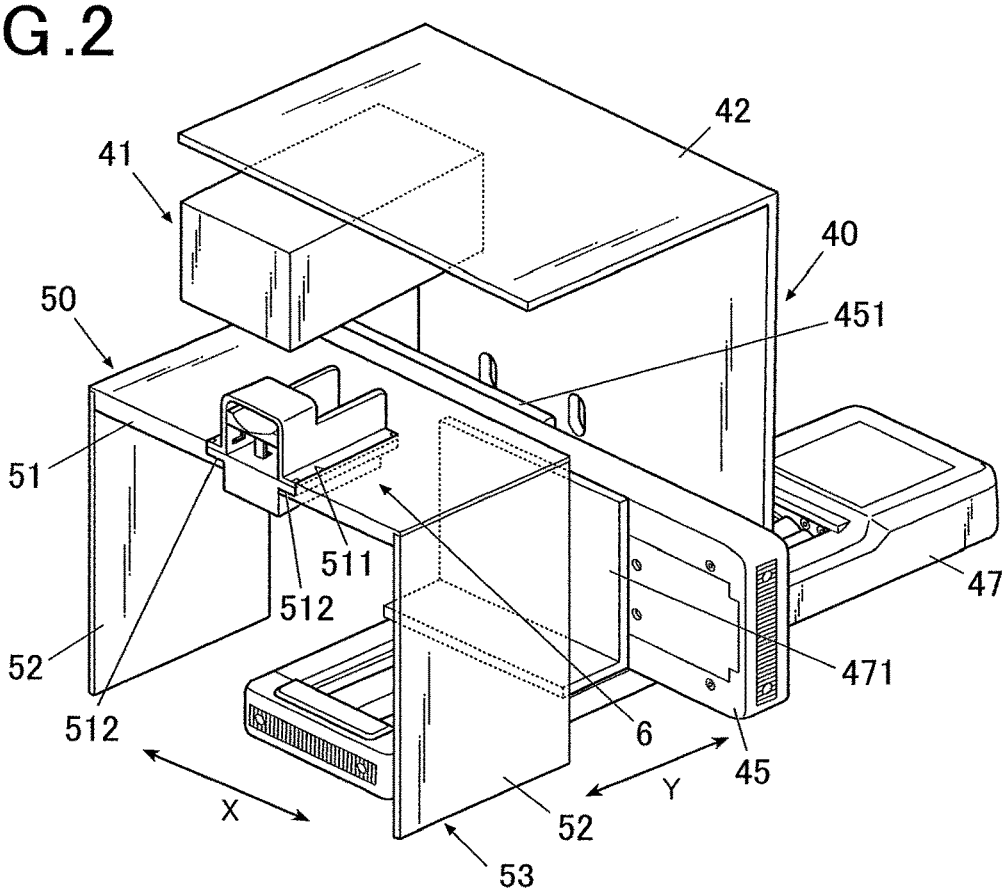
FIG. 2 is a perspective view of a main part of the internal configuration of the printing apparatus according to the embodiment.

FIG. 2 is a perspective view of the main part of the nail printer 2 in FIG. 1 without the case 21, illustrating the internal configuration thereof.

In the case 21, the printer 40 that prints a design on the nail T of the print finger U1 and the fixture platform 50 that positions the print finger U1 and the nail T are disposed as illustrated in FIG. 2.

The printer 40 includes a printing head 41 as a main component of the printer, a unit supporting member 42 that supports the printing head 41, an X-direction moving stage 45 and an X-direction actuating motor 46 for moving the printing head 41 in the X direction (X direction in FIG. 1 and the like or the width direction of the nail printer 2), a Y-direction moving stage 47 and a Y-direction actuating motor 48 for moving the printing head 41 in the Y direction (Y direction in FIG. 1 and the like, the depth direction of the nail printer 2), and the like. In the embodiment, the X-direction actuating motor 46, the Y-direction actuating motor 48 and the like constitute a head actuator 49 (see FIG. 6) that moves the printing head 41.

The printing head 41 of the embodiment is an ink-jet head that prints an image by ink-jet printing.

For example, the printing head 41 is constituted by an ink cartridge-integrated head in which ink cartridges (not shown) of yellow (Y), magenta (M) and cyan (C) inks are integrally formed with ink ejectors (not shown) disposed on respective faces (bottom faces in FIG. 1 and FIG. 2 in the embodiment) opposed to the printing object (surface of the nail T). The ink ejectors include respective nozzle arrays each composed of nozzles for jetting the corresponding ink, and the printing head 41 prints an image by forming micro-droplets of the inks and directly spraying them from the ink ejectors to a printing area of the printing object (nail T). The printing head is not limited to the above-described example that ejects inks of the three colors. It may further include another ink cartridge for storing a different ink and a corresponding ink ejector.

The unit supporting member 42 is fixed to an X-direction moving portion 451 attached to the X-direction moving stage 45. The X-direction moving portion 451 is actuated by the X-direction actuating motor 46 to move in the X direction on the X-direction moving stage 45 along a guide (not shown). Accordingly, the printing head 41 attached to the unit supporting member 42 moves in the X direction (X direction in FIG. 2 or the width direction of the nail printer 2).

The X-direction moving stage 45 is fixed to an Y-direction moving portion 471 of the Y-direction moving stage 47. The Y-direction moving portion 471 is actuated by the Y-direction actuating motor to move in the Y direction on the Y-direction moving stage 47 along a guide (not shown). Accordingly, the printing head 41 attached to the unit supporting member 42 moves in the Y direction (Y direction in FIG. 2 or the depth direction of the nail printer 2).

In the embodiment, the X-direction moving stage 45 or the Y-direction moving stage 47 is constituted by a combination of the X-direction actuating motor 46 or the Y-direction actuating motor 48 with a ball screw and a guide (not shown).

In the embodiment, the X-direction actuating motor 46, the Y-direction actuating motor 48 and the like constitute a head actuator 49, which is an X-Y actuator that moves the printing head 41 in the X and Y directions.

The printing head 41, the X-direction actuating motor 46 and the Y-direction actuating motor 48 of the printer 40 are connected to a printing controller 313 (see FIG. 6) of the hardware processor 30 (described later) to be controlled by the printing controller 313.

The communicator 24 is configured to be able to send and receive information to and from the device 7.

As described above, the communication between the nail printer 2 and the device 7 may be based on any method, and the communicator 24 includes an antenna chip and the like compatible to the communication method of the device 7.

The communicator 24 is connected to a communication controller 311 (see FIG. 6) of the hardware processor 30 (described later) to be controlled by the communication controller 311.

The fixture platform 50 includes a finger mounting table 53 that includes a top plate 51 corresponding to an X-Y plane opposed to the ink ejectors of the printing head and a support 52 supporting the top plate 51 at a predetermined height.

In the top plate 51 of the finger mounting table 53, an approximately rectangular (U-shaped) notch 511 is formed approximately at a center in the width direction of the printer (i.e. the X direction in FIG. 2), which is open to the front side of the printer.

In the notch 511, an inward flange 512 (see FIG. 3A, FIG. 4) is formed. The flange 512 functions as a guide that guides the fixture jig 6 to a predetermined position in the fixture platform 50, which is described later.

As used herein, the term "predetermined position" refers to a position within a movable range Ar (see FIG. 4 and FIG. 5) of the printing head 41 in the X-Y plane, in which the reference mark F and the nail T are at a location suitable for the printer 40 to print an image. In the embodiment, it refers to a position within the movable range Ar in which the nail T is approximately at a center in the X-Y direction.

Figure 4:
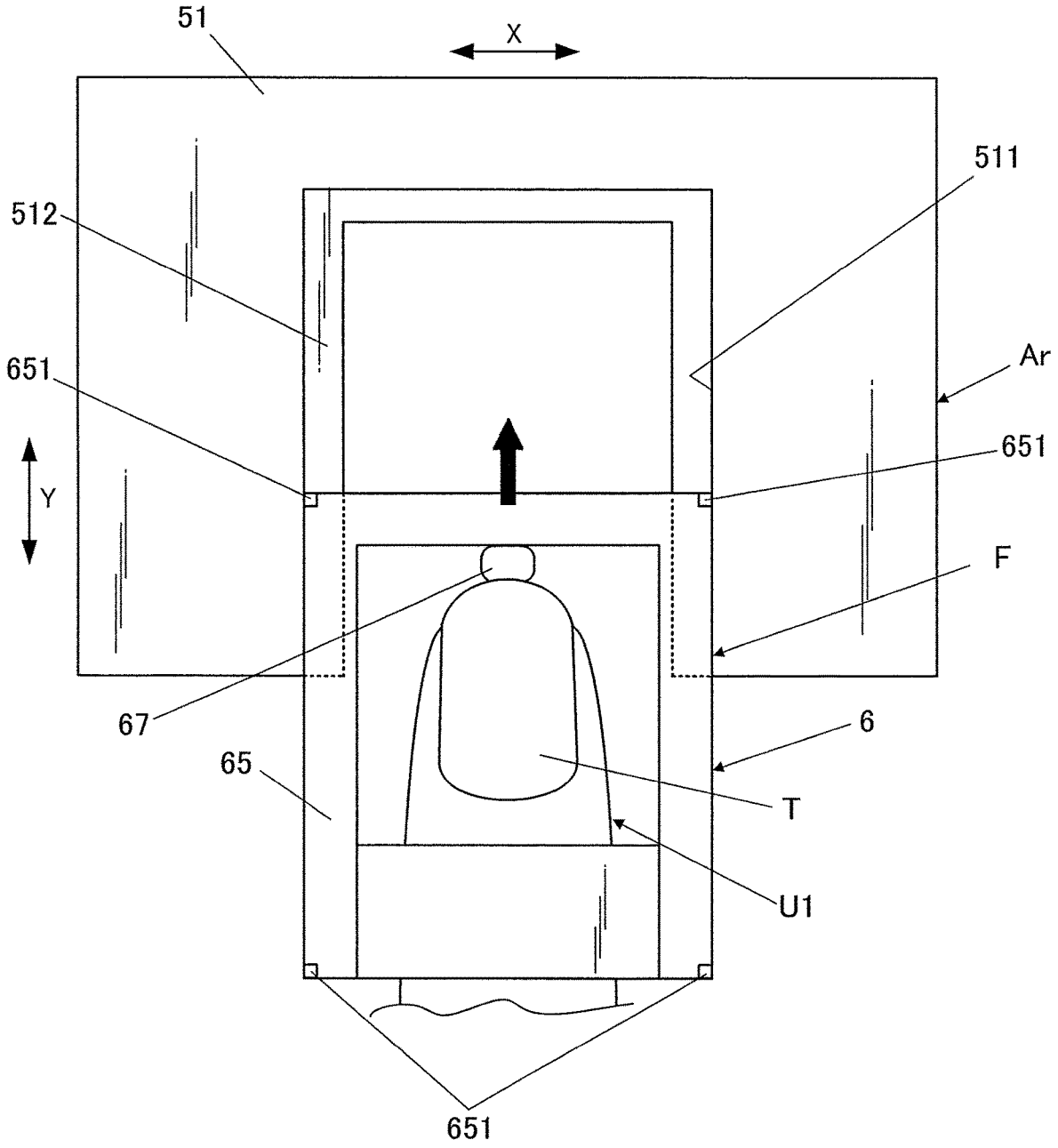
FIG. 4 is a plan view of the fixture jig being mounted in a fixture platform.

The embodiment is an example in which the flange 512 is disposed along the entire edge of the rectangular notch 511 (see FIG. 4). However, the area of the flange 512 is not limited thereto. For example, the flange 512 may be provided only in both sides in the X direction of the notch 511. Further, the flange 512 may not be continuously provided but may be provided in separate pieces.

In the notch 511 of the top plate 51, a fixture jig 6 is detachably disposed.

The fixture jig 6 has a reference mark F (see FIG. 4 and FIG. 5) as a reference for setting a printing area of the printer 40. Further, the fixture jig 6 fixes the print finger U1.

In the following, the configuration of the fixture jig 6 of the embodiment will be described in detail referring to FIG. 3A and FIG. 3B.

Figure 3A:
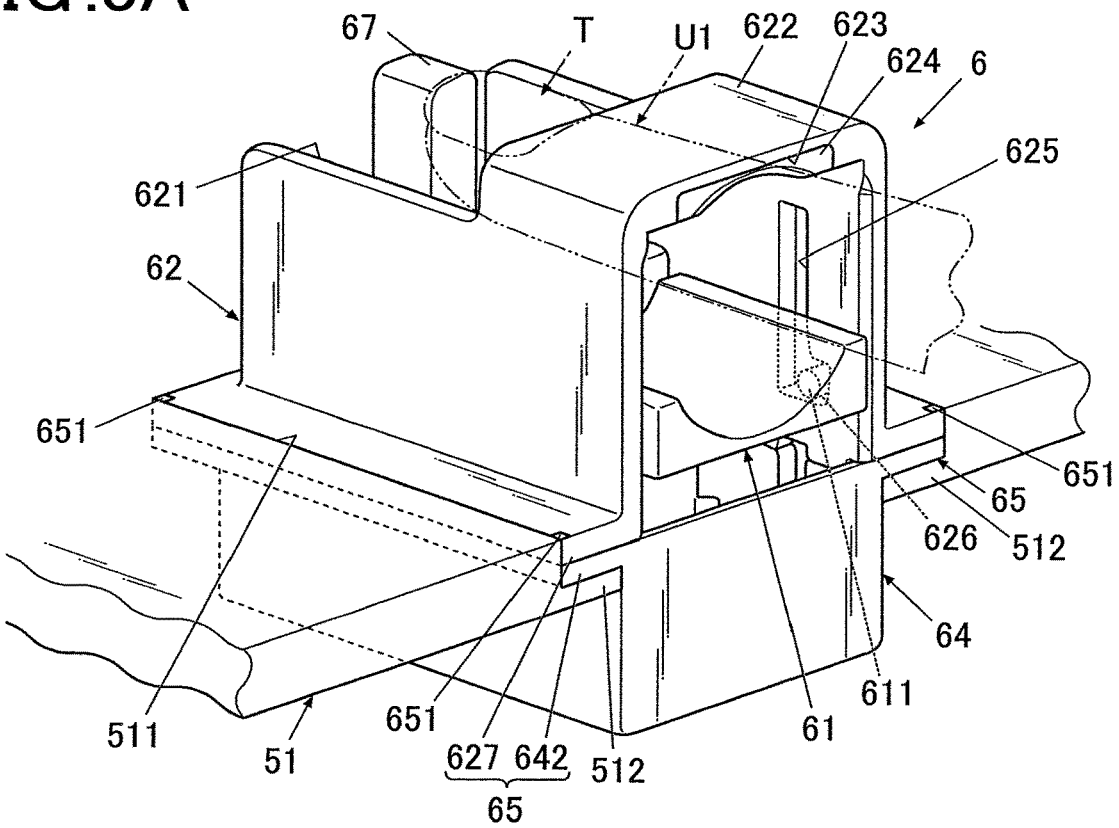
FIG. 3A is a perspective view of a fixture jig according to the embodiment from diagonally above.
Figure 3B:
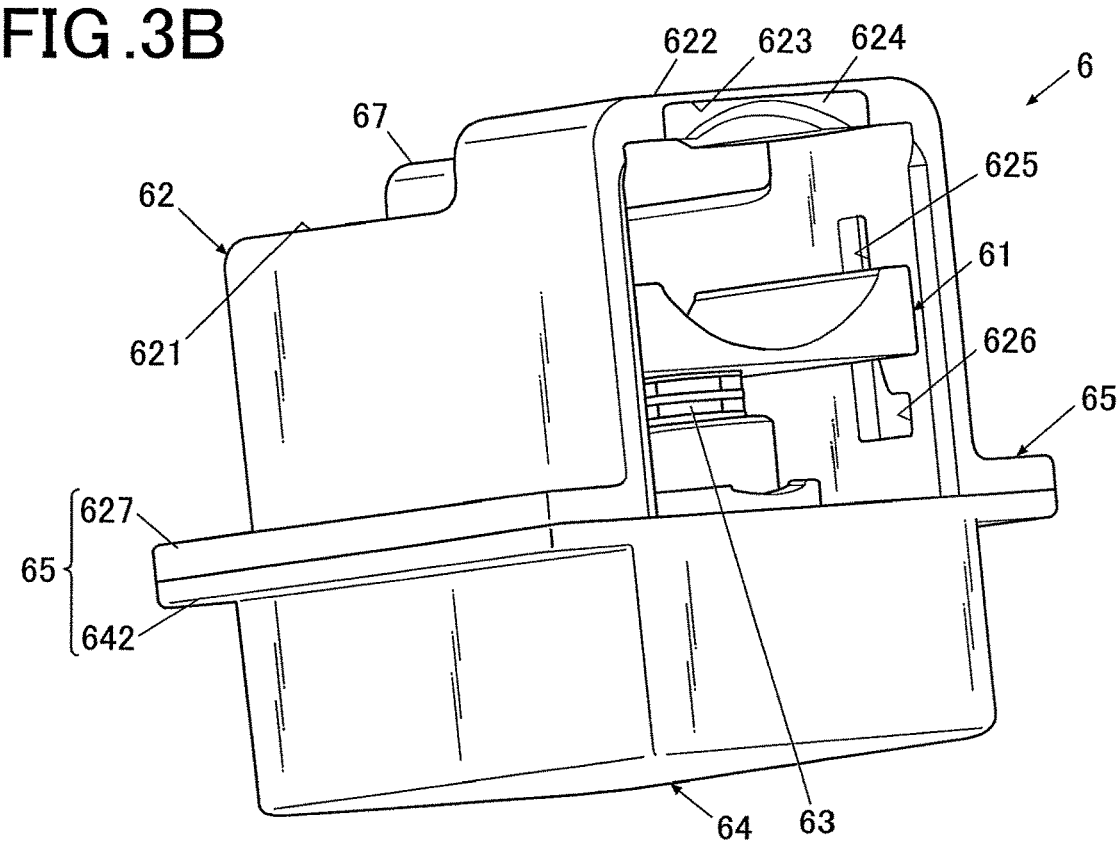
FIG. 3B is a perspective view of the fixture jig according to the embodiment from diagonally below.

FIG. 3A is a perspective view of the fixture jig according to the embodiment from diagonally above, and FIG. 3B is a perspective view of the fixture jig according to the embodiment from diagonally below.

As illustrated in FIG. 3A and FIG. 3B, the fixture jig 6 includes a finger mount 61 on which the print finger U1 is to be mounted, a cover 62, and an biasing member 63 that biases the finger mount 61 toward the cover 62.

In the embodiment, the fixture jig 6 is configured such that the finger mount 61 and the biasing member 63 for biasing the finger mount 61 are disposed in a space defined by the cover 62, which is an upper case in an approximately box shape, and a lower case 64 similarly in an approximately box shape as illustrated in FIG. 3A and FIG. 3B.

The finger mount 61 is provided to mount the finger (print finger U1) of the nail T as a printing object, which is constituted by a plate member.

It is preferred that a finger mounting face of the finger mount 61 (upper face in FIG. 3A and the like) on which the print finger U1 is to be mounted has an arc cross section as illustrated in FIG. 3A and FIG. 3B so that it fits the shape of the print finger U1 to be mounted thereon.

At both sides in the width direction of the finger mount 61, engaging protrusions 611 protrude. The engaging protrusions 611 are movable in the height direction (height direction in FIG. 3A and the like) along the guide grooves 625 (described later) of the cover 62.

By the engaging protrusions 611 being guided by the guide grooves 625, the finger mount 61 is movable in the direction closer to or away from the cover 62 (i.e. the height direction in FIG. 3A and the like).

One end of the biasing member 63 is engaged with a back face (i.e. the opposite face from the finger mounting face or the bottom face in FIG. 3A, FIG. 3B and the like) of the finger mount 61.

The other end of the biasing member 63 is engaged, for example, with an inner bottom face or the like of the lower case 64.

In the embodiment, the biasing member 63 is constituted by a coil spring.

The biasing member 63 biases the finger mount 61 upward to push it up.

The biasing member 63 is not limited to a coil spring and may be any member that is elastically deformable and resilient.

In the fixture jig 6, a nail mount 67 for mounting the nail T of the print finger U1 is disposed at a front side in the direction of inserting the print finger In the embodiment, the nail mount 67 is formed integrally in the lower case 64. The nail mount 67 may be any member that can position a tip of the nail T, and the shape, the position and the like thereof are not limited to the illustrated example. For example, the nail mount 67 may be disposed at a rear side on the top face of the finger mount 61.

By setting the fixture jig 6 in the nail printer 2 with the nail T mounted on the nail mount 67, the nail T is disposed in such a position in the X-Y plane that is suitable for the printing head 41 of the printer 40 to correctly print a design.

Further, by mounting the nail T on the nail mount 67, the position in the height direction of the nail T is also fixed at a predetermined height suitable for printing.

Accordingly, the nail T is suitably positioned in the X-Y direction and the height direction only by fixing the print finger U1 on the fixture jig 6 and mounting the nail T on the nail mount 67. In this way, it is possible to readily and suitably position the nail T.

As illustrated in FIG. 3A and the like, the cover 62 is open to the rear side in the direction of inserting the print finger (i.e. the front side of the printer when the fixture jig 6 is set in the notch 511 of the top plate 51 of the finger mounting table 53 of the printer body).

Further, the cover 62 has a window 621 in a top face at the front side in the direction of inserting the print finger, and the nail T of the print finger U1 fixed to the fixture jig 6 is exposed through the window 621. The cover 62 includes a finger press 622 that is disposed at the rear side in the direction of inserting the print finger to prevent the print finger U1 from moving excessively upward.

As illustrated in FIG. 3A and FIG. 3B, a recess 623 is formed in the inner face of the finger press 622 of the embodiment. In the recess 623, a cushion 624 made of a flexible soft resin such as silicone is disposed.

With the cushion 624 that is disposed in the finger press 622 at a portion that comes in contact with an upper side of the print finger U1 (i.e. in an inner face of the finger press 622 or an upper face of the cover 62), the user is less likely to feel an impact or a pain when the print finger U1 is pushed up to abut the finger press 622. This is favorable for the user.

The configuration of the finger press 622 is not limited to the illustrated example. For example, it may be constituted by a simple plate with no cushion 624.

As illustrated in FIG. 3A and FIG. 3B, guide grooves 625 are formed in both inner side faces of the cover 62 to guide the finger mount 61 in the height direction (height direction in FIG. 3A and FIG. 3B) when the finger mount 61 moves up and down.

The guide grooves 625 extends in the height direction (vertical direction) of the cover 62. Lower ends (i.e. portions furthest from the cover 62) of the guide grooves 625 are formed in an approximately L-shape that extends to the rear side in the direction of inserting the print finger, and the extended portions at the rear side in the direction of inserting the print finger serve as protrusion engaging portions 626 that engage with the engaging protrusions 611 of the finger mount 61.

When the engaging protrusions 611 of the finger mount 61 reach the upper ends of the guide grooves 625, they are stopped not to move further upward. That is, the guide grooves 625 also function as stoppers that define the highest position of the finger mount 61.

The guide grooves 625 gradually incline toward the lower ends where the protrusion engaging portions 626 are disposed, so that the engaging protrusions 611 of the finger mount 61 are guided into the protrusion engaging portions 626 along the guide grooves 625 when the finger mount 61 is moved down to the lowest position.

When the engaging protrusions 611 of the finger mount 61 are in the protrusion engaging portions 626, the finger mount 61 is held at the lowest position despite the biasing force of the biasing member 63 so as to keep an insertion opening widely open when the print finger U1 is inserted into the fixture jig 6.

As described above, the embodiment has a locking mechanism that locks the finger mount 61 in a position away from the cover 62 by the engaging protrusions 611 disposed on the finger mount 61 and the protrusion engaging portions 626 disposed on the cover 62 to engage with the engaging protrusions 611.

A bottom face of the cover 62 is open, and an outward flange 627 is formed along a peripheral edge of the opening.

Further, an upper face of the lower case 64 is open, and an outward flange 642 is formed along a peripheral edge of the opening.

In the embodiment, the fixture jig 6 is assembled such that the cover 62 is fit on the lower case 64 with the opening facing downward so that the outward flanges 627, 642 of the cover 62 and the lower case 64 are aligned with each other, and the outward flanges 627, 642 are fixed to each other by adhesion or the like. The outward flanges 627, 642 are thus fixed and integrated to be an engaging overhang 65. The method to fix the outward flanges 627, 642 is not limited to adhesion. For example, they may be fixed by screwing, fusion or the like.

Figure 5:
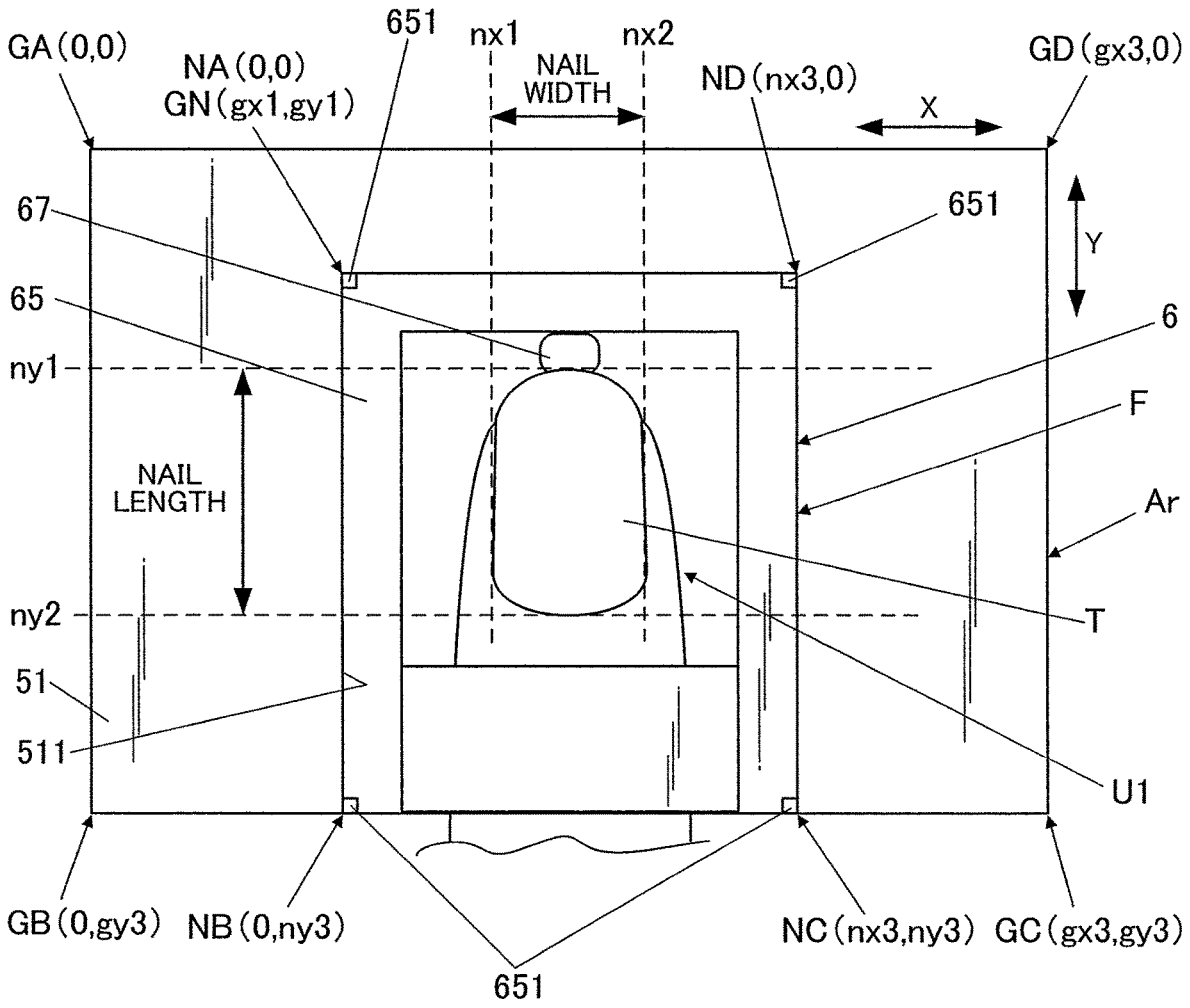
FIG. 5 is a plan view of the fixture jig that is mounted in the fixture platform.

FIG. 4 is a plan view illustrating the fixture jig being set in the notch of the top plate of the finger mounting table of the fixture platform, and FIG. 5 is a plan view of the fixture jig that is set in the notch of the top plate.

To set the fixture jig 6 in the notch 511 of the top plate 51 of the finger mounting table 53 of the fixture platform 50, the engaging overhang 65 is placed on the top face of the flange 512 of the notch 511 as illustrated in FIG. 4. Then, the engaging overhang 65 is guided along the top face of the flange 512 as a guide until the rear side of the engaging overhang 65 abuts the rear side of the notch 511. In this way, the fixture jig 6 can be smoothly moved to the predetermined position in which the nail T and the reference mark F is at a suitable position for printing.

The configuration for precisely setting the fixture jig 6 in the predetermined position in the fixture platform 50 is not limited to the above-described example. For example, a guide groove or a guide rib to be engaged with a guide groove may be formed in an outer side face of the engaging overhang 65, and a guide rib or a guide groove that corresponds to the guide groove or guide rib of the engaging overhang 65 may be formed in a corresponding position in an inner side face of the notch 511. The guide rib is guided by the guide groove so that the fixture jig 6 is always precisely mounted in the predetermined position in the fixture platform 50.

As illustrated in FIG. 4 and FIG. 5, in the embodiment, an outer periphery of the engaging overhang 65 is identical to the outer periphery of the fixture jig 6, and this outer periphery of the fixture jig 6 serves as the reference mark F for setting the printing area of the printer 40.

Specifically, indicators 651 that define the reference mark F are provided at intersections between peripheral sides of the engaging overhang 65 (i.e. four corners of the engaging overhang 65). The indicators 651 are formed by printing, pasting stickers or the like. A detection processor 814 (described later) of the device 7 detects the indicators 651 and determines the position of the reference mark F from the indicators 651.

The reference mark F is not limited to being identical to the outer periphery of the engaging overhang and may be set in the top plate 51 of the finger mounting table 53 at any location within a movable range Ar as a printable range of the printer 40 and outside an area where the nail T is to be mounted. That is, the reference mark F may be provided inside the outer periphery of the engaging overhang 65.

The reference mark F is not limited to a rectangular shape and may have any shape that is precisely recognizable by image processing, e.g. a square shape.

While the embodiment illustrates an example in which the reference mark F has a frame shape, the reference mark F is not limited to the frame shape and may have any shape that can indicate a reference position.

In the embodiment, the detection processor 814 detects the reference mark F and performs a keystone correction if necessary. In terms of keystone correction, it is preferred that the reference mark F has a frame shape. However, it is possible to perform a keystone correction on any reference mark F that can define vertices of a rectangle.

The shape, the number and the like of the indicators 651 are not limited to the illustrated example, and they may be constituted by any marks or the like that are detectable by the detection processor 814 of the device 7. For example, the indicators 651 may be constituted by "■", "□", "●", "○", L-shape marks or any combination thereof. Alternatively, the indicators 651 may be constituted by a line along the reference mark F. When the indicators 651 are constituted by a line, it may be provided either over the entire periphery of the reference mark F or only at a part of the periphery. Further, the reference mark F may be indicated by painting the area inside the reference mark F in a different color from the outside.

Control Configuration of Nail Printer and Device of Printing System

Figure 6:
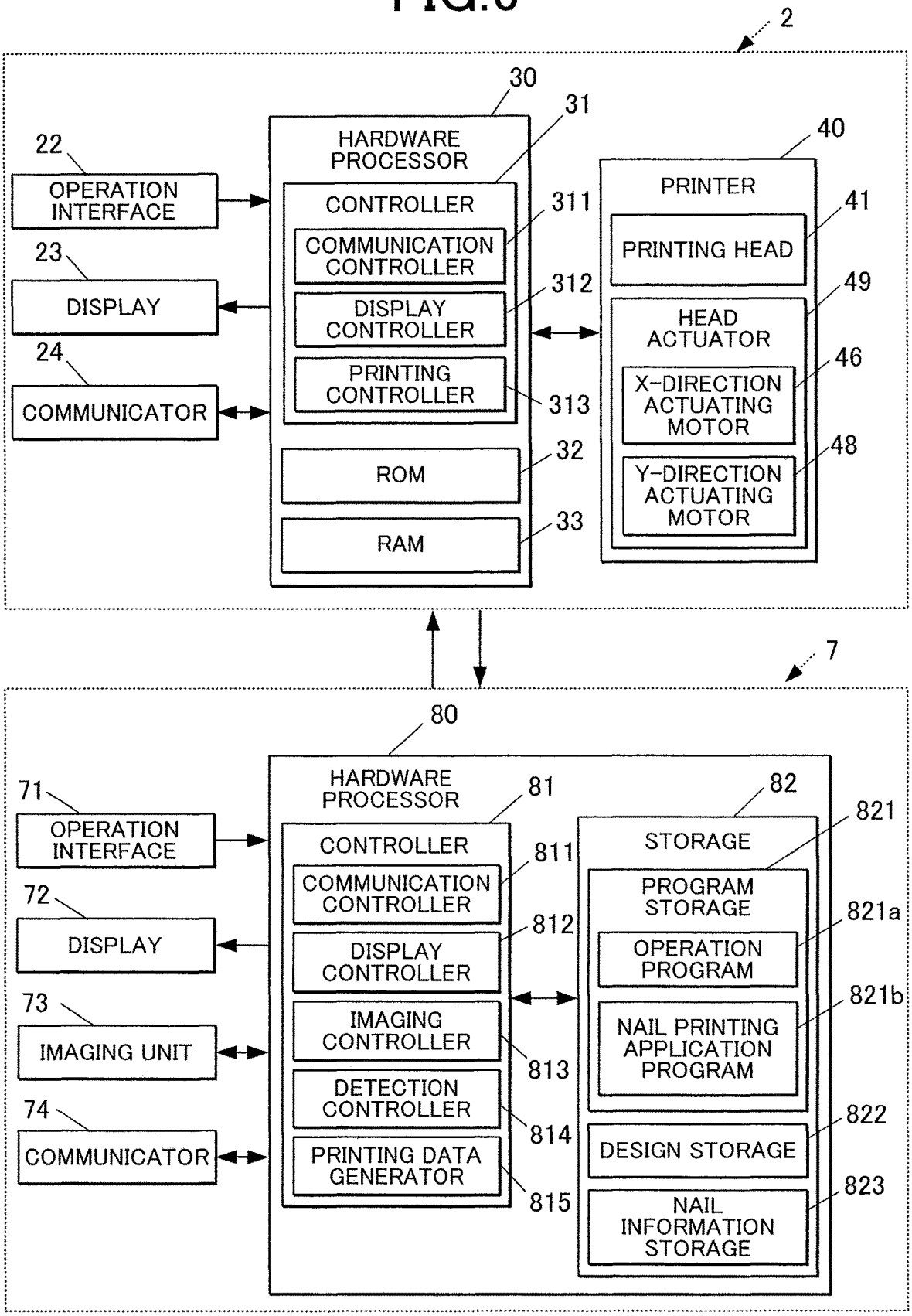
FIG. 6 is a block diagram of a main part of the printing system according to the embodiment, illustrating the control configuration thereof.

FIG. 6 is a block diagram of the main control configuration of the nail printer 2 and the device 7 of the printing system 1 according to the embodiment.

As illustrated in FIG. 6, the nail printer 2 of the embodiment includes the hardware processor 30 as well as the operation interface 22, the display 23, the communicator 24 and the printer 40 as described above.

As illustrated in FIG. 6, the hardware processor 30 is constituted by a computer that includes a controller 31 composed of a CPU (central processing unit) and the like (not shown) and a storage 32 composed of a ROM (read only memory), a RAM (random access memory) and the like (not shown).

In the storage 32, a variety of programs and data for operating the nail printer 2 and the like are stored.

Specifically, a printing program for printing processing and the like are stored in the ROM, and the hardware processor 30 develops these programs, for example, in a work area of the RAM to execute them so as to control the printer and the like of the nail printer 2.

In terms of function, the controller 31 includes a communication controller 311, a display controller 312, a printing controller 313 and the like. The functions as the communication controller 311, the display controller 312, the printing controller 313 are achieved by a cooperation of the CPU of the controller 31 and the programs stored in the ROM of the storage 32.

The communication controller 311 controls the operation of the communicator 24. In the embodiment, it controls communication with the device 7 and receives printing data and the like sent from the device 7. When there is an abnormality in an operation status of the nail printer 2 such as a trouble during printing, a report may be sent to the device 7.

The display controller 312 controls the display 23 to display a variety of screens on the display 23. In the embodiment, the display controller 312 displays messages and instructions to the user and the like on the display 23.

When printing data is sent from the device 7, the printing controller 313 controls the components of the printer 40 to perform a printing operation according to the printing data so as to print a nail design on the surface of the nail T.

Specifically, the printing controller 313 outputs a control signal to the printer 40 based on the printing data to control the printing head 41, the X-direction actuating motor 46, the Y-direction actuating motor 48 of the printer 40 and the like so as to print a design according to the printing data in a predetermined area on the nail T while suitably moving the printing head 41 in the X and Y directions.

In the embodiment, the printing controller 313 performs an offset correction before it controls the printer 40 to start printing processing.

In order to set an area in which a design is actually printed (i.e. the nail area), it is required to precisely determine the locational relationship between an X-Y scanning area (i.e. the movable range Ar of the printing head 41) of the nail printer 2 and the position of the reference mark F of the fixture jig 6. In this regard, information on the locational relationship (locational relationship information) is represented by a value (offset value) unique to the nail printer 2 that depends on the mechanical design requirements, the machining accuracy and the like of the printer.

In the embodiment, it is assumed that the printer has already obtained such locational relationship information. When the printing controller 313 obtains printing data from the device 7, it corrects the position of the nail T (nail area) based on the locational relationship information.

The offset correction by the printing controller 313 will be described in detail with FIG. 5 and the like.

As illustrated in FIG. 5, there are two X-Y coordinate systems that are an X-Y scanning area coordinate system based on the movable range Ar of the printing head 41 of the printer 40 of the nail printer 2 and a coordinate system of the fixture jig 6 that fixes the print finger U1 and the nail T.

The X-Y scanning area coordinate system of the nail printer 2 corresponds to the area surrounded by points "GA", "GB", "GC" and "GD" in FIG. 5 with the point "GA" (rear left point of the movable range Ar) at the origin. In the embodiment, the printing head 41 is movable in the X and Y directions within this area. However, an actual printable area of the printing head 41 is the area inside the reference mark F.

In contrast, the coordinate system of the fixture jig 6 that fixes the print finger U1 and the nail T corresponds to the area surrounded by points "NA", "NB", "NC" and "ND" in FIG. 5 with the point "NA" (rear left point of the reference mark F) at the origin.

As illustrated in FIG. 5, the origin "NA" of the coordinate system of the fixture jig 6 is represented as "GN" (gx1 gy1) in the X-Y scanning area coordinate system of the nail printer 2, and this coordinate point is the value (offset value) unique to the printer that depends on its mechanical design factors.

The size of the reference mark F is prestored in the nail printer 2, and the scales of the X-Y scanning area coordinate system (origin at the point "GA") of the nail printer 2 and the coordinate system (origin at the point "NA") of the fixture jig 6 are adjusted based on this actual size.

Assuming such scale adjustment has already been made, the points "NA, NB, NC and ND" in the coordinate system of the fixture jig 6 are represented respectively as NA (gx1, gy1), NB (gx1, gy1+ny3), NC (gx1+nx3, gy1+ny3), ND (gx1+nx3, gy1) in the X-Y scanning area coordinate system of the nail printer 2 according to the offset value.

The printing controller 313 performs the offset correction to convert the coordinate of the printing data received from the device 7 to the coordinate according to the offset value. As a result, it is possible to reflect an individual difference between printers to print a design in a correct nail area.

As illustrated in FIG. 6, the device 7 of the embodiment, which can communicate with the nail printer 2 as a printing apparatus, includes an operation interface 71, a display 72, an imaging unit 73, a communicator 74, a hardware processor 80 and the like.

The device 7 of the embodiment includes a capacitive touch panel 70 that serves as the operation interface 71 and the display 72.

With the touch panel 70 as the operation interface 71, the user can perform a variety of operations such as inputs and setting by touch gestures. In response to a user operation on the operation interface 71, an input signal corresponding to the operation is sent to the controller 81. The operation interface 71 is not limited to the touch panel 70. For example, a variety of operation buttons, a keyboard, a pointing device and the like may be provided as the operation interface 71.

In the embodiment, the user can select a nail design to be printed on the nail T by operating the operation interface 71.

The touch panel 70 as the display 72 displays a variety of screens by a control of the display controller 812 (described below).

In the embodiment, the display 72 can display a nail design input or selected by the user through the operation interface 71, an image of the nail T and the print finger U1 and an image of the reference mark F taken by the imaging unit 73.

For example, the imaging unit 73 is a small camera composed of an imaging element, a lens, a light and the like (e.g. LED) (all not shown).

In the embodiment, the imaging unit 73 images the fixture jig 6 with the print finger U1 fixed thereon at a location outside the nail printer 2 so as to obtain an image including the reference mark F of the fixture jig 6 and the nail T.

The angle, the imaging position, the number of shooting and the number of images to be obtained are not particularly limited. For example, the fixture jig 6 and the print finger U1 fixed thereon may be imaged once from straight above or multiple times while changing the imaging angle to obtain two or more images.

The imaging unit 73 is connected to the imaging controller 813 (see FIG. 6, described later) of the hardware processor 80 to be controlled by the imaging controller 813.

The image data of an image taken by the imaging unit 73 is stored in a nail information storage 823 (described later) of the storage 82.

The communicator 74, which can send printing data to the nail printer 2, includes a wireless communication module and the like that can communicate with the communicator 24 of the nail printer 2.

The communicator 74, which may be constituted by any device that can communicate with the nail printer 2, is compatible with the communication standard of the communicator 24 of the nail printer 2.

As illustrated in FIG. 6, the hardware processor 80 of the device 7 of the embodiment is constituted by a computer that includes a controller 81 composed of a CPU (central processing unit) and the like (not shown) and a storage 82 composed of a ROM (read only memory), a RAM (random access memory) and the like (not shown).

In the storage 82, a variety of programs and data for operating the device 7 are stored.

Specifically, a nail printing application program 821*b* (hereinafter referred to as a "nail print app") for nail printing with the nail printer 2 and the like is stored in the ROM of the embodiment as well as an operation program 821*a* for integrally controlling the components of the device 7, and the hardware processor 80 develops these programs, for example, in a work area of the RAM to control the device 7.

The storage 82 of the embodiment includes a design storage 822 for storing nail design data, nail information storage 823 for storing an image of the nail T, information on the nail T such as the position and the area thereof and the like.

In terms of function, the controller 81 includes a communication controller 811, the display controller 812, the imaging controller 813, the detection processor 814, a printing data generator 815 and the like. The functions as the communication controller 811, the display controller 812, the imaging controller 813, the detection processor 814 and the printing data generator 815 are achieved by cooperation of the CPU of the controller 31 and the programs stored in the storage 32 of the CPU.

The communication controller 811 controls the operation of the communicator 74. In the embodiment, it controls communication with the nail printer 2 and sends printing data to the nail printer 2. When the nail printer 2 sends some information, the communication controller 811 controls the communicator 74 to receive it.

The display controller 812 controls the display 72 to display a variety of screens on the display 72.

In the embodiment, the display controller 812 displays a design selection screen on the display 72, which prompts the user to select a nail design that he/she wants to print on the nail T. When displaying the design selection screen, the display controller 812 displays nail designs stored in the design storage 822 sequentially or in a list on the display 72.

When the imaging unit 73 takes an image of the nail T and the reference mark F, the display controller 812 may display the image on the display 72.

Further, the display controller 812 may overlay a nail design selected by the user on an image of the nail T on the display 72 so that the user can check an expected result before actual printing. This allows the user to reselect another nail design when he/she does not like it.

The display controller 812 may display messages and instructions to the user on the display 72.

The imaging controller 813 controls the imaging unit 73 to perform various imaging.

In the embodiment, the imaging controller 813 controls the imaging unit 73 to perform imaging such that the print finger U1 (and the nail T) fixed on the fixture jig 6 and the reference mark F are shown in a single image, so as to obtain the image.

When lighting is necessary due to the location of the fixture jig 6 or the like, the imaging controller 813 may turn on a light (illuminating device) of the imaging unit 73 to do imaging under illumination.

The detection processor 814, which is a functional section that performs various image processing, detects the position of the reference mark F and the area of the nail T from the image obtained by the imaging unit 73.

First, the detection processor 814 detects the indicators 651 from the image obtained by the imaging unit 73 and then detects the reference mark F from the position of the indicators 651. In the embodiment, the indicators 651 are provided at the four corners of the engaging overhang 65, which are identical to the outer edge of the reference mark F. The detection processor 814 detects the position of the indicators 651 to detect a tetragon (rectangle in the embodiment) having the four indicators 651 as the vertices as the reference mark F.

The detection processor 814 performs keystone correction on the detected reference mark F.

In the embodiment, the fixture jig 6 is placed at a location outside the nail printer 2 when it is imaged. In such conditions, it is expected that the imaging with the imaging unit 73 may not be done from straight above of the fixture jig 6 but may sometimes be done from a deviated angle. In this case, the reference mark F, which is a rectangle in a plan view, may not be imaged in a correct shape but in a skewed or inclined shape such as a trapezoid. Since the device knows that that the reference mark F has a rectangular shape in a plan view, it corrects the imaged image so that the reference mark F is shown in a rectangular shape. Further, a camera shake may occur in the imaging. In this case, detection processor 814 may suitably perform image stabilization to obtain a non-blurry image.

Then, the detection processor 814 obtains X-Y coordinate data of the four corners (NA, NB, NC and ND in FIG. 5) of the reference mark F as coordinate data based on the reference point of the reference mark F (NA (0, 0), NB (0, ny3), NC (nx3, ny3), ND (nx3, 0) in FIG. 5).

The detection processor 814 recognizes the contours of the print finger U1 and the nail T from the image obtained by the imaging unit 73 so as to obtain X-Y coordinate data thereof based on the reference point of the reference mark F.

The contours of the print finger U1 and the nail T may be recognized from an image, for example, by a technique of determining a boundary from color difference. However, the method of recognizing the contours is not limited thereto.

When two or more images taken from different angles are obtained by the imaging unit 73, the detection processor 814 may determine the curvature of the nail T from the images.

The image processing for recognizing the reference mark F and the image processing for recognizing the contours of the print finger U1 and the nail T may be performed on either the same image or different images with different setting such as trimming or filtering.

The printing data generator 815 sets the printing area of the printer 40 based on the detection result by the detection processor 814.

That is, when the length of the nail T detected by the detection processor 814 is between ny1 and ny2, the width thereof is between nx1 and nx2 as illustrated in FIG. 5, the nail area is an area between (nx1, ny1) and (nx2, ny2) in the reference mark F.

The printing data generator 815 trims image data of a nail design selected by the user, i.e. a printing subject and suitably enlarges or reduces it according to the shape of the nail area (contour of the nail T) so as to generate region fill data for the nail area which is the printing area in the reference mark F. Further, the printing data generator 815 fills the area outside the nail area in the reference mark F with blank data (data representing non-printing area). The printing data thus generated is composed of the blank data in the rectangular reference mark F and the region fill data of the nail area.

When the print finger U1 is fixed on the fixture jig 6 and the nail T is imaged, the nail T may be imaged from different angles to obtain two or more images and the detection processor 814 may determine the curvature or the like of the nail T from the images. In such cases, the printing data generator 815 may perform a curved surface correction on the printing data based on the determined curvature or the like of the nail T. With such a curved surface correction, the printing data to be generated is more compatible to the shape of the nail T.

The same data processing is performed when the printing data is generated for a finger area, which is the area of the print finger, instead of the nail area.

The printing data generated by the printing data generator 815 is sent to the nail printer 2 though the communicator 74.

Function of Printing System

Figure 7:
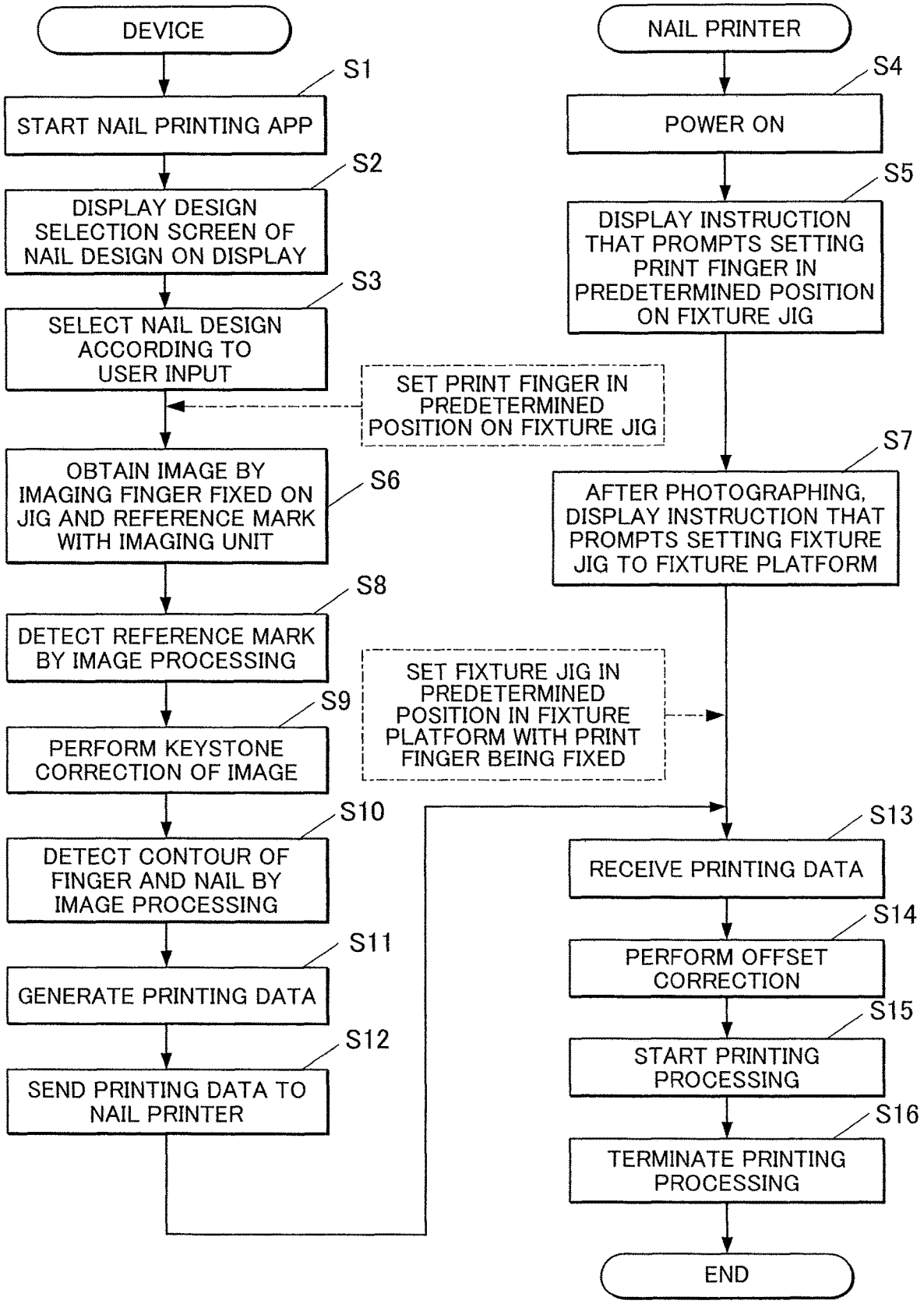
FIG. 7 is a flowchart of printing processing of the printing system according to the embodiment.

The functions of the printing system 1 according to the embodiment will be described referring to FIG. 7 and the like.

To print a nail design on the nail T with the printing system 1 of the embodiment, the user selects execution of nail print processing on the operation interface 71 of the device 7. Then, the nail print app 821*b* starts (Step S1). When the nail print app 821*b* starts, the display controller 812 reads nail designs from the design storage 822 and displays a design selection screen on the display 72 to prompt the user to select a nail design (Step S2). In response to a user input such as a touch gesture of selecting a nail design from among the nail designs displayed on the design selection screen, the desired nail design is selected as a design to be printed on the nail T (Step S3).

On the other hand, when the nail printer 2 is turned on (Step S4), the display controller 312 of the nail printer 2 displays an instruction screen on the display 23 (Step S5), which prompts the user to set the print finger U1 in the predetermined position on the fixture jig 6.

The screen that prompts the user to set the print finger U1 on the fixture jig 6 may be displayed on the display 72 of the device 7 or on both displays 23, 72.

According to the instruction, the user sets the print finger U1 on the fixture jig 6 and images the print finger U1 fixed on the fixture jig 6 and the reference mark F with the imaging unit 73 of the device 7. Accordingly, the device 7 obtains an image of the print finger U1 fixed on the fixture jig 6 and the reference mark F (Step S6).

After the imaging is completed, an instruction that prompts the user to set the fixture jig 6 in the fixture platform 50 with the print finger U1 fixed thereon (Step S7) is displayed on the display 23 of the nail printer 2, and the user sets the fixture jig 6 in the predetermined position of the fixture platform 50 according to the instruction. The instruction that prompts the user to set the fixture jig 6 in the fixture platform 50 may be displayed on the display 72 of the device 7 or on both displays 23, 72.

In the embodiment, as illustrated in FIG. 4, the user fits the fixture jig 6 into the notch 511 of the fixture platform 50 by sliding it on the flange 512 and pushes the fixture jig 6 in the direction of the solid black arrow until an end at the insertion side of the fixture jig 6 abuts the bottom of the notch 511. As a result, the fixture jig 6 is set in the predetermined position of the fixture platform 50 as illustrated in FIG. 5.

On the other hand, the detection processor 814 of the device 7 detects the reference mark F by image processing on the image obtained by the imaging unit 73 (Step S8). When the detected reference mark F is skewed, it performs a keystone correction to correct the image so that the contour of the nail T in the reference mark F is in a suitable position for printing. The detection processor 814 thus detects the rectangular reference mark F with no skew or inclination (Step S9).

Then, the detection processor 814 detects the contours of the print finger U1 and the nail T by image processing on the image obtained by the imaging unit 73 (Step S10).

When the detection processor 814 detects the reference mark F and the contours of the print finger U1 and the nail T, the printing data generator 815 generates printing data based on the detection result by the detection processor 814 (Step S11).

The device 7 sends the printing data generated by the printing data generator 815 to the nail printer 2 through the communicators 24, 74 (Step S12).

When the nail printer 2 receives the printing data (Step S13), the printing controller 313 of the nail printer 2 performs the offset correction on the printing data (Step S14). The printing controller 313 then outputs the corrected printing data to the printer 40, and it starts printing processing (Step S15). When the printer 40 finishes printing the nail design on the nail T (Step S16), the printing processing of the embodiment ends.

A notification of the end of the printing processing may be displayed on the display 23 or the like.

When the printing processing ends, the user takes the fixture jig 6 out of the printer, detaches the fixture jig 6 from the print finger U1 and performs posttreatment such as drying the printing area or further applying an overcoat.

Although not described in the above description, when the printing system 1 of the embodiment is used to print an image on the nail T, it is preferred that the user performs pretreatment of applying a white undercoat or the like on the nail area and thereafter fixes the print finger U1 and the nail T on the fixture jig 6.

Further, when the printing system 1 of the embodiment is used to perform nail printing, it is preferred that the user registers the fingers (e.g. ten fingers from thumbs to little fingers of both hands) on which an image will be printed at least at the first use by fixing them on the fixture jig 6, imaging them and storing the imaged images in the storage 82 of the device 7 along with identification information of the user and the type of finger (i.e. thumb, little finger, etc.). In this case, the registered information is held unless it is reset or updated. In the second or later printing processing, the previously registered information may be referenced as default information.

By registering an image of the nail T along with supplementary information such as the user and the type of finger thereof beforehand, it is possible to exclusively or preferentially display designs compatible to the shape (size and characteristics such as bold or thin) and the like of the nail T on the design selection screen for selecting a nail design.

For example, the user may set the system to print different designs on the individual fingers sequentially from the thumb. When an image of the nail T is prestored along with the type of finger thereof, the system may compare the image of the nail T obtained in the above-described Step 6 with the prestored image of the nail T linked to the type of finger. If the system determines that they are different images, it may display a message such as "A wrong finger is set." on the display 72 or the like to make an alert to the user.

Advantageous Effect of Printing System

As described above, in the embodiment, the fixture jig 6 is detachable from the nail printer 2, and the fixture jig 6 together with a print finger U1 and a nail T fixed thereon is imaged at a location outside the nail printer 2 to obtain an image of the reference mark F and the nail T. The position of the reference mark F and the area of the nail T are detected from the obtained image, the nail area as a printing area of the printer 40 is detected from the detection result, and printing data is generated.

Therefore, it is not necessary to provide a camera, a light and the like for obtaining an image to the nail printer 2. This can eliminate a work such as alignment of the camera and reduce the cost of the printer itself. Since the internal wiring and the like are not complicated, the printer can have a simple configuration.

Further, image recognition of an image taken by the camera and generation of printing data based on the recognition result are also performed by the device 7. Therefore, the nail printer 2 does not require resources (e.g. circuit size, memory, storage for storing reference files) for such computing, and an inexpensive small device can satisfy the requirement. This can also reduce the cost and simplify the printer configuration.

Unlike a system in which an image is taken by a nail printer and the image is sent to an external device for image processing and the like, it is not necessary to send and receive image data between the nail printer 2 and an external device. This can reduce the time required for data communication and increase the processing speed. Therefore, fast printing processing can be achieved.

Although the steps from imaging to generation of printing data are performed by the device 7 as described above, the locational coordinate of the nail T relative to the nail printer 2 can be accurately determined. This is because the fixture jig 6 that fixes the print finger U1 and the nail T has the reference mark F, and the print finger U1 and the nail T are imaged along with the reference mark F. Therefore, when the fixture jig 6 is set in the nail printer 2 to print a design, the printing area (nail area) can be accurately set and precise printing processing can be performed on the nail area.

In the embodiment, the fixture jig 6 that fixes the print finger U1 and the nail T is taken out of the printer when they are imaged. Therefore, it is not necessary to form an imaging window for attaching a camera and the like in the nail printer 2. This improves the design flexibility of the printer.

Since the imaging is performed at a location outside the printer, the user can put his/her hand anywhere. This can reduce the burden on the user.

When printing a design, mist of ink ejected from the printing head 41 may be scattered in the nail printer 2. If a camera is disposed in the printer, the ink mist may adhere to a lens or other camera components and contaminate them. In this regard, since the imaging is performed at a location outside the printer in the embodiment, there is no risk of contamination of the imaging unit 73 by ink mist.

In the embodiment, the indicators 651 that define the reference mark F are disposed at the outer periphery of the fixture jig 6, and the detection processor 814 detects the position of the reference mark F by detecting the indicators 651.

That is, detection of the position of the reference mark F requires only detecting the indicators 651. Therefore, the reference mark F can be detected readily with high precision.

In the embodiment, the fixture platform 50 includes the flange 65 as a guide that guides the fixture jig 6 to the predetermined position.

This enables disposing the fixture jig 6 always in an accurate position when setting it in the nail printer 2. After the imaging at a location outside the printer, the fixture jig 6 can be set accurately without checking the position thereof in the printer.

Variations of Printing System

While an embodiment of the present invention is described, the present invention is not limited to the embodiment, and various changes can be made without departing from the features of the present invention.

For example, the embodiment illustrates an example in which the design storage 822 for storing image data of a nail design is provided in the storage 82 of the device 7. However, the location of image data of a nail design is not limited to the storage of the device 7.

For example, the system may be configured such that image data of a nail design is stored in a server or the like that is connectable through a network so that the image data of the nail design can be referenced through an access to the server.

This enables the user to select a design to be printed from among a larger number of nail designs.

In the embodiment, the printing head 41 of the nail printer (printing apparatus) 1 is an inkjet printing head. However, the printing head 41 is not limited thereto.

For example, the nail printer may include a pen holder that holds a pen for printing a design on the surface of the nail T, and it prints the design with the pen. The nail printer may include both the inkjet printing head as in the embodiment and the pen holder that holds a printing pen, and it prints a design with two or more printing means.

The nail printer 2 may include a dryer such as a heater or a fan for drying ink after printing.

In the embodiment, the nail printer 2 includes the display 23. However, when the system is configured such that images, instructions and messages to the user and the like are all displayed on the display 72 of the device 7, the display 23 of the nail printer 2 may be omitted.

This can further reduce the cost and simplify the nail printer 2.

The embodiment illustrates an example in which the print finger U1 and nail T are fixed on the fixture jig 6 during the imaging and the printing processing. However, the object on which the present printing system can print a design is not limited to the nail T of the print finger U1.

For example, nail-like objects such as nail chips to be attached to the nail T are regarded as a "nail" on which the printing system can print a design.

While some embodiments of the present invention are described, the scope of the present invention is not limited to the above-described embodiments but encompasses the invention recited in the claims and the equivalents thereof.

What is claimed is:

1. A printing system, comprising:

a printing apparatus; and a device, wherein the printing apparatus comprises:

a printing head which prints a design on a nail of a print finger or toe;

a fixture jig which is detachable from the printing apparatus, which includes a reference mark, and which fixes the print finger or toe; and a fixture platform in which the fixture jig is set such that the reference mark and the nail of the print finger or toe are in an X-Y plane, wherein the device comprises:

a communicator which communicates with the printing apparatus;

an imaging unit which images the fixture jig with the print finger or toe fixed thereon to obtain an image of the reference mark and the nail; and a processor, wherein the processor (i) detects a position of the reference mark and an area of the nail from the image obtained by the imaging unit and (ii) sets a printing area of the printing head based on a detection result by the processor and generates printing data, and wherein the processor controls the imaging unit to image the fixture jig with the print finger or toe fixed thereon at a location outside the printing apparatus so as to obtain the image of the reference mark and the nail.

2. The printing system according to claim 1, wherein the reference mark is used as a reference when the processor corrects a position of the nail in the image to a suitable position for printing.

3. The printing system according to claim 1, wherein an indicator which defines the reference mark is provided at an outer periphery of the fixture jig, and wherein the processor detects the position of the reference mark by detecting the indicator.

4. The printing system according to claim 1, wherein the fixture platform comprises a guide which guides the fixture jig to a predetermined position.

5. The printing system according to claim 1, wherein the processor calculates at least one of a length of the nail and a width of the nail based on the detection result by the processor.

6. A device, comprising:

a communicator that communicates with a printing apparatus which comprises: a printing head which prints a design on a nail of a print finger or toe; a fixture jig which is detachable from the printing apparatus, which includes a reference mark, and which fixes the print finger or toe; and a fixture platform in which the fixture jig is set such that the reference mark and the nail are in an X-Y plane;

an imaging unit; and a processor, wherein the processor:

(i) obtains an image of the reference mark and the nail by controlling the imaging unit to image the fixture jig with the print finger or toe fixed thereon at a location outside the printing apparatus, (ii) detects a position of the reference mark and an area of the nail from the obtained image, (iii) sets a printing area of the printing head based on a detection result of the area of the nail and generates printing data, and (iv) sends the printing data to the printing apparatus by controlling the communicator.

7. A non-transitory computer-readable recording medium storing a program which is readable by a computer of a device which comprises: a communicator which communicates with a printing apparatus; and an imaging unit, wherein the printing apparatus comprises: a printing head which prints a design on a nail of a print finger or toe; a fixture jig which is detachable from the printing apparatus, which comprises a reference mark, and which fixes the print finger or toe; and a fixture platform in which the fixture jig is set such that the reference mark and the nail are in an X-Y plane, the program being executable by the computer to control the device to perform processes comprising:

obtaining an image of the reference mark and the nail by the imaging unit to image the fixture jig with the print finger or toe fixed thereon at a location outside the printing apparatus;

detecting a position of the reference mark and an area of the nail from the obtained image;

setting a printing area of the printing head based on a detection result of the area of the nail and generating printing data; and sending the printing data to the printing apparatus by the communicator.

* * * * *